US009279607B2

(12) United States Patent
Yamashita

(10) Patent No.: US 9,279,607 B2
(45) Date of Patent: Mar. 8, 2016

(54) METHOD OF PART REPLACEMENT FOR REFRIGERATION CYCLE APPARATUS

(75) Inventor: Koji Yamashita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 293 days.

(21) Appl. No.: 13/880,318

(22) PCT Filed: Dec. 3, 2010

(86) PCT No.: PCT/JP2010/007046

§ 371 (c)(1),
(2), (4) Date: Apr. 18, 2013

(87) PCT Pub. No.: WO2012/073292

PCT Pub. Date: Jun. 7, 2012

(65) Prior Publication Data

US 2013/0205813 A1 Aug. 15, 2013

(51) Int. Cl.

| | |
|---|---|
| ***F25B 45/00*** | (2006.01) |
| ***F25B 49/00*** | (2006.01) |
| *F25B 13/00* | (2006.01) |

(52) U.S. Cl.

CPC ..... *F25B 45/00* (2013.01); *F25B 49/005* (2013.01); *F25B 13/00* (2013.01); *F25B 2400/121* (2013.01); *F25B 2500/06* (2013.01)

(58) Field of Classification Search

CPC ..... F25B 45/00; F25B 2345/001
USPC ..... 62/77, 292
See application file for complete search history.

(56) References Cited

U.S. PATENT DOCUMENTS

| | | | | |
|---|---|---|---|---|
| 3,808,826 | A * | 5/1974 | Harper et al. | 62/612 |
| 3,898,857 | A * | 8/1975 | Bourguet et al. | 62/117 |
| 2004/0213879 | A1 | 10/2004 | Jang | |

FOREIGN PATENT DOCUMENTS

| | | | |
|---|---|---|---|
| EP | 1 418 390 | A1 | 5/2004 |
| JP | 04-184054 | A | 7/1992 |
| JP | 05-164437 | A | 6/1993 |
| JP | 05-170227 | A | 7/1993 |
| JP | 10-306289 | A | 11/1998 |
| JP | 2001-174109 | A | 6/2001 |
| JP | 2003-500400 | A | 1/2003 |

(Continued)

OTHER PUBLICATIONS

Office Action mailed Mar. 18, 2014 in corresponding JP Application No. 2012-546578 (English Translation).

(Continued)

*Primary Examiner* — Melvin Jones
(74) *Attorney, Agent, or Firm* — Posz Law Group, PLC

(57) ABSTRACT

A part replacement method for replacement of a part of a refrigeration cycle apparatus includes a refrigerant circuit in which a flammable refrigerant is circulated and a container connecting device for controlling the refrigerant such that the refrigerant is allowed to flow out of the refrigerant circuit. The method includes a refrigerant recovery step of allowing the refrigerant to flow out of the refrigerant circuit through the container connecting device, a pressure reduction step of connecting a pressure reducing device to the container connecting device to reduce a pressure in the refrigerant circuit until the pressure in the refrigerant circuit reaches a set pressure or a setting time is reached, and a part replacement step of removing the part from the refrigerant circuit by heating to replace the part.

12 Claims, 3 Drawing Sheets

(56) References Cited

FOREIGN PATENT DOCUMENTS

| | | | |
|---|---|---|---|
| JP | 2004-116885 | A | 4/2004 |
| JP | 2004-286403 | A | 10/2004 |
| JP | 2005-500214 | A | 1/2005 |
| JP | 2009-297341 | A | 12/2009 |
| WO | 00-71530 | A | 5/2010 |
| WO | 2010/049998 | A | 5/2010 |

OTHER PUBLICATIONS

Extended European Search Report dated Aug. 5, 2014 in corresponding EP Application No. 10860338.2 (English Translation).

Office Action dated Sep. 2, 2014 issued in corresponding CN patent application No. 2010800702377 (and English translation).

Office Action dated Nov. 17, 2014 issued in corresponding AU patent application No. 2010364872.

Office Action dated Dec. 2, 2014 issued in corresponding JP patent application No. 2012-546578 (and English translation).

Extended European Search Report dated Jul. 23, 2015 issued in corresponding EP patent application No. 15155189.2.

International Search Report of the International Searching Authority mailed Mar. 15, 2011 for the corresponding international application No. PCT/JP2010/007046 (with English translation).

Office Action mailed Apr. 8, 2015 in the corresponding CN application No. 201080070237.7 (English Translation attached).

* cited by examiner

METHOD OF PART REPLACEMENT FOR REFRIGERATION CYCLE APPARATUS

CROSS REFERENCE TO RELATED APPLICATION

This application is a U.S. national stage application of International Patent Application No. PCT/JP2010/007046 filed on Dec. 3, 2010.

TECHNICAL FIELD

The present invention relates to methods of part replacement for a refrigeration cycle apparatus, such as a multi-air-conditioning apparatus for a building, using a flammable refrigerant as a refrigerant. The present invention relates to a part replacement method used to replace a component of a refrigeration cycle apparatus on site (installation site), for example, after completion of construction of a refrigeration cycle by installation of the refrigeration cycle apparatus filled with a refrigerant.

BACKGROUND

Air-conditioning apparatuses, such as a multi-air-conditioning apparatus for a building, include an air-conditioning apparatus in which a refrigerant is circulated between an outdoor unit and a relay unit and a heat medium, such as water, is circulated between the relay unit and an indoor unit to reduce conveyance power for the heat medium while circulating the heat medium, such as water, through the indoor unit (refer to Patent Literature 1, for example).

In some related-art refrigeration cycle apparatuses, such as a multi-air-conditioning apparatus for a building, for example, a refrigerant pipe and a pipe part of a device are heated using, for example, a burner and are fixed (connected) with a brazing material (or by brazing). In a case where a part constituting a refrigerant circuit is broken and therefore has to be replaced in such a refrigeration cycle apparatus, the use of a nonflammable refrigerant permits, for example, a refrigerant pipe to be heated with a burner or the like immediately after recovery of the refrigerant in a recovery tank, such that the brazing material can be melted and the refrigerant pipe can be removed and replaced.

In an air-conditioning apparatus recently developed, an operation procedure which avoids ignition during part replacement in the use of a flammable refrigerant is defined (refer to Patent Literature 2, for example).

CITATION LIST

Patent Literature

Patent Literature 1: International Publication No. WO10-049998 (Page 3, FIG. 1, for example)

Patent Literature 2: Japanese Unexamined Patent Application Publication No. 2004-116885 (Page 7, FIG. 1, for example)

Technical Problem

For example, in the air-conditioning apparatus, such as a multi-air-conditioning apparatus for a building, disclosed in Patent Literature 1, the refrigerant is circulated between the outdoor unit and the relay unit. In addition, the heat medium, such as water, is circulated between the relay unit and the indoor unit. The relay unit is configured to allow the refrigerant to exchange heat with the heat medium, such as water. Accordingly, although the refrigerant can be prevented from leaking into an indoor space, provision for safety during part replacement is not particularly described. For example, in replacement of a component in the same manner as related art, if the concentration of a flammable refrigerant in a refrigerant pipe is higher than its flammability limit, the refrigerant may, for example, ignite with the flame of a burner. Disadvantageously, safety problems remain unsolved.

As for the air-conditioning apparatus disclosed in Patent Literature 2, the operation procedure for component replacement is disclosed and the concentration and pressure of the refrigerant in a pipe at which ignition or the like is avoided are described a little. A variation in concentration of the refrigerant in a pipe within a refrigeration cycle depending on temperature is not described. As for numerical values described, the basis of calculation of these values is not disclosed. Accordingly, this replacement procedure is hardly versatile. Furthermore, disadvantageously, the time required to reduce the pressure to a set value is not defined.

SUMMARY

The present invention has been made to overcome the above-described disadvantages and provides a safe refrigeration cycle apparatus which uses a flammable refrigerant and prevents the flammable refrigerant from, for example, igniting with the flame of, for example, a burner during replacement of a component of the refrigeration cycle apparatus.

The present invention provides a method for replacement of a part of a refrigeration cycle apparatus including a compressor that compresses a flammable refrigerant, a condenser that condenses the refrigerant by heat exchange, an expansion device that controls a pressure of the condensed refrigerant, and an evaporator that exchanges heat between the pressure-reduced refrigerant and air to evaporate the refrigerant, the compressor, the condenser, the expansion device, and the evaporator being connected by pipes to form a refrigerant circuit, the method including a refrigerant recovery step of allowing the refrigerant to flow out of the refrigerant circuit through a container connecting device, a pressure reduction step of connecting a pressure reducing device to the container connecting device to reduce a pressure in the refrigerant circuit through the container connecting device until the pressure in the refrigerant circuit reaches a set pressure or a setting time is reached, and a part replacement step of removing the part from the refrigerant circuit by heating to replace the part. If a component of the refrigeration cycle apparatus is broken, the amount of the flammable refrigerant remaining in refrigerant pipes can be reduced and the component can be safely removed from the refrigeration cycle apparatus and be replaced without causing, for example, ignition of the refrigerant.

In the method of part replacement for the refrigeration cycle apparatus according to the invention, for replacement of a part constituting the refrigerant circuit in the refrigeration cycle apparatus, a pressure of a refrigerant in the refrigerant circuit is reduced such that, for example, the refrigerant has a concentration less than its flammability limit and heating is then performed using, for example, a burner to remove and replace the part. Advantageously, for example, safe removal can be achieved while, for example, ignition of the refrigerant is being prevented.

DETAILED DESCRIPTION

Embodiment

Figure 1:
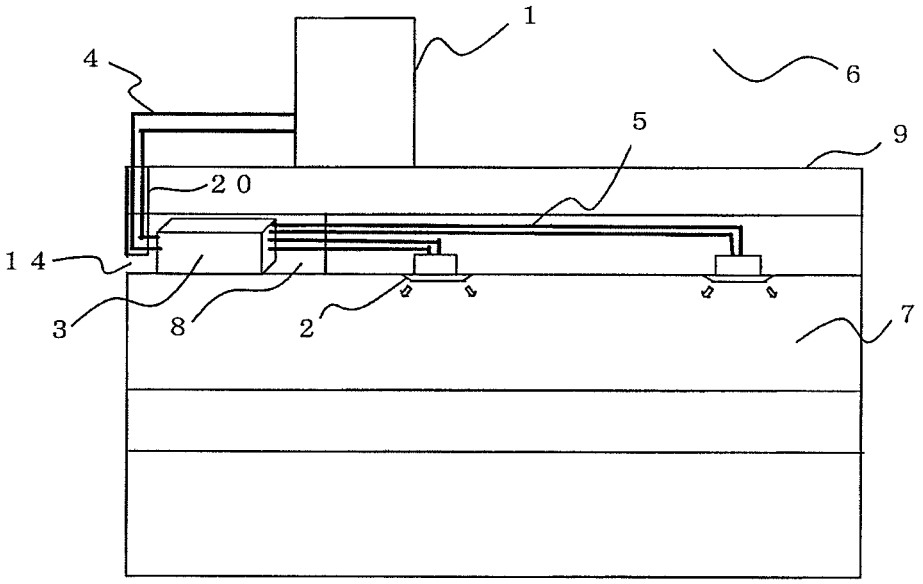
FIG. 1 is a system configuration diagram of a refrigeration cycle apparatus 100 according to Embodiment of the invention.

Embodiment of the invention will be described with reference to the drawings. FIG. 1 is a schematic diagram illustrating an example of installation of an air-conditioning apparatus according to Embodiment of the invention. The example of installation of the air-conditioning apparatus will be described with reference to FIG. 1. This air-conditioning apparatus uses units including devices constituting circuits (a refrigerant circuit (refrigeration cycle) A and a heat medium circuit B), through each of which a flammable heat source side refrigerant (hereinafter, referred to as the "refrigerant") or a heat medium, such as water, serving as a refrigerant, is circulated, to permit each indoor unit to freely select a cooling mode or a heating mode as an operation mode. Note that the dimensional relationship among components in FIG. 1 and the following figures may be different from the actual one. Furthermore, in the following description, when the same devices distinguished from one another using subscripts do not have to be distinguished from one another or specified, the subscripts may be omitted.

In FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 is configured to exchange heat between the refrigerant circulating in the refrigerant circuit A and the heat medium, serving as a load (heat exchange target) for the refrigerant. The outdoor unit 1 is connected to the heat medium relay unit 3 by refrigerant pipes 4 through which the refrigerant is conveyed. The heat medium relay unit 3 is connected to each indoor unit 2 by pipes (heat medium pipes) 5 through which the heat medium is conveyed. Cooling energy or heating energy produced in the outdoor unit 1 is delivered through the heat medium relay unit 3 to the indoor units 2.

The outdoor unit 1, typically disposed in an outdoor space 6 which is a space (e.g., a roof) outside a structure 9, such as a building, is configured to supply cooling energy or heating energy through the heat medium relay unit 3 to the indoor units 2. Each indoor unit 2 is disposed at a position where the unit can supply cooling air or heating air to an indoor space 7 which is a space (e.g., a living room) inside the structure 9 and is configured to supply the cooling air or heating air to the indoor space 7, serving as an air-conditioned space. The heat medium relay unit 3 is configured so as to include a housing separated from housings of the outdoor unit 1 and the indoor units 2 such that the heat medium relay unit 3 can be disposed at a different position from those of the outdoor space 6 and the indoor space 7. The heat medium relay unit 3 is connected to the outdoor unit 1 through the refrigerant pipes 4 and is connected to the indoor units 2 through the pipes 5 to transfer cooling energy or heating energy, supplied from the outdoor unit 1, to the indoor units 2.

As illustrated in FIG. 1, in the air-conditioning apparatus according to Embodiment, the outdoor unit 1 is connected to the heat medium relay unit 3 using two refrigerant pipes 4 and the heat medium relay unit 3 is connected to each indoor unit 2 using two pipes 5. As described above, in the air-conditioning apparatus according to Embodiment, each of the units (the outdoor unit 1, the indoor units 2, and the heat medium relay unit 3) is connected using two pipes (the refrigerant pipes 4 or the pipes 5), thus facilitating construction.

FIG. 1 illustrates a state where the heat medium relay unit 3 is disposed in a different space from the indoor space 7, for example, a space above a ceiling (hereinafter, simply referred to as a "space 8") inside the structure 9. The space 8, which is not a hermetically enclosed space, is configured to allow air flow to/from the outdoor space 6 through a vent 14 positioned in the structure. The vent 14 in the structure may be of any type capable of permitting air flow to/from the outdoor space 6 due to natural convection or forced convection to prevent an excessive increase in concentration of the refrigerant in the space 8 upon leakage of the refrigerant into the space 8. Furthermore, although FIG. 1 illustrates a case where the indoor units 2 are of a ceiling cassette type, the indoor units are not limited to this type and may be of any type, such as a ceiling concealed type or a ceiling suspended type, capable of blowing out heating air or cooling air into the indoor space 7 directly or through a duct or the like.

In the air-conditioning apparatus in FIG. 1, a flammable refrigerant is used as the refrigerant circulating in the refrigerant circuit. Examples of the flammable refrigerant used include tetrafluoropropene expressed by the chemical formula $C_3H_2F_4$ (for example, HFO1234yf expressed by $CF_3CF{=}CH_2$ or HFO1234ze expressed by $CF_3CH{=}CHF$) and difluoromethane (R32) expressed by the chemical formula $CH_2F_2$. Alternatively, a refrigerant mixture containing the above refrigerants may be used. As regards the proportion of each refrigerant, for example, the refrigerant mixture is 80% HFO1234yf and 20% R32. Alternatively, a highly flammable refrigerant, such as R290 (propane), may be used.

The heat medium relay unit 3, therefore, may be installed in any place other than a living space and allows air flow to/from the outdoors in any manner, for example, a space other than the space above the ceiling. For example, the heat medium relay unit 3 can be installed in a common space in which an elevator or the like is installed and which allows air flow to/from the outdoors.

Although FIG. 1 illustrates the case where the outdoor unit 1 is placed in the outdoor space 6, the placement is not limited to this case. For example, the outdoor unit 1 may be placed in an enclosed space, for example, a machine room with a ventilation opening, and can be installed in any place which allows air flow to/from the outdoor space 6.

In addition, the number of outdoor units 1, the number of indoor units 2, and the number of heat medium relay units 3 which are connected are not limited to the numbers illustrated in FIG. 1. The numbers may be determined depending on the structure 9 where the air-conditioning apparatus according to Embodiment is installed.

Furthermore, it is preferred that air flow should not be allowed between the indoor space 7 and the space 8, where the heat medium relay unit 3 is placed, in order to prevent the refrigerant from leaking into the indoor space 7 when the refrigerant leaks from the heat medium relay unit 3. If a small vent, such as a hole through which a pipe extends, is disposed between the space 8 and the indoor space 7, as long as air-flow resistance in the vent between the space 8 and the indoor space 7 is set greater than that in the vent between the space 8 and the outdoor space 6, problems will not arise because the leaked refrigerant is discharged to the outdoors.

In addition, as illustrated in FIG. 1, the refrigerant pipes 4 connecting the outdoor unit 1 and the heat medium relay unit 3 extend via the outdoor space 6 or through a pipe shaft 20. The pipe shaft is a duct through which a pipe extends and is enclosed by, for example, metal. Accordingly, if the refrigerant leaks from any of the refrigerant pipes 4, the refrigerant will not be spread in the vicinity. Since the pipe shaft is disposed in a non-air-conditioned space other than the living space or the outdoors, the refrigerant leaked from the refrigerant pipe 4 will be discharged from the pipe shaft via the non-air-conditioned space 8 or directly to the outdoors without leaking into the indoor space. Furthermore, the heat medium relay unit 3 may be disposed in the pipe shaft.

Figure 2:
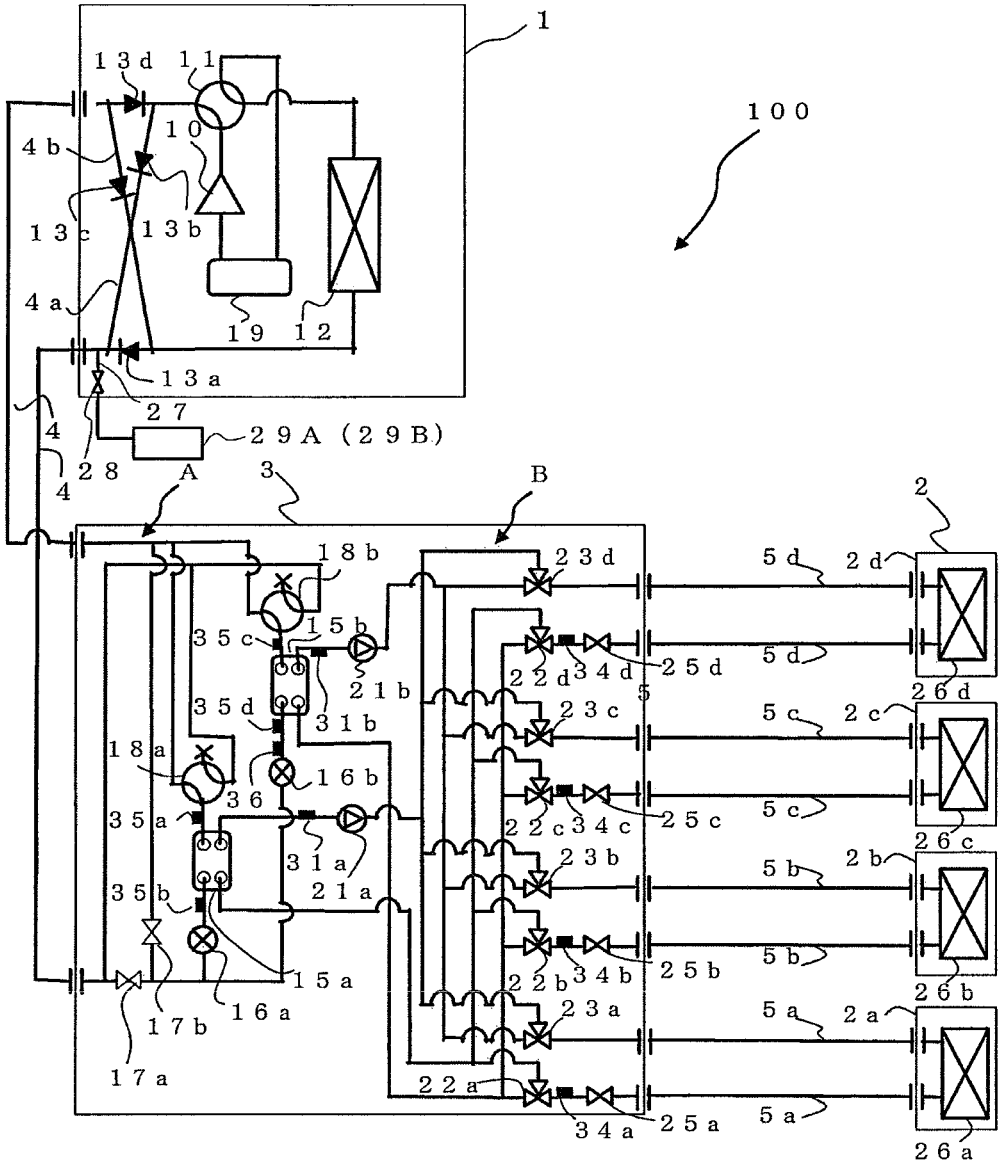
FIG. 2 is a system circuit diagram of the refrigeration cycle apparatus 100 according to Embodiment of the invention.

FIG. 2 is a schematic diagram illustrating an exemplary circuit configuration of the air-conditioning apparatus (hereinafter, referred to as a "refrigeration cycle apparatus 100"), serving as an example of a refrigeration cycle apparatus, according to Embodiment. The detailed configuration of the refrigeration cycle apparatus 100 will be described with reference to FIG. 2. Referring to FIG. 2, the outdoor unit 1 and the heat medium relay unit 3 are connected by the refrigerant pipes 4 through a heat exchanger related to heat medium 15*a* and a heat exchanger related to heat medium 15*b* which are arranged in the heat medium relay unit 3. Furthermore, the heat medium relay unit 3 and each indoor unit 2 are also connected by the pipes 5 through the heat exchanger related to heat medium 15*a* and the heat exchanger related to heat medium 15*b*. The refrigerant pipes 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19 which are connected in series by the refrigerant pipes 4. The outdoor unit 1 further includes a first connecting pipe 4*a*, a second connecting pipe 4*b*, a check valve 13*a*, a check valve 13*b*, a check valve 13*c*, and a check valve 13*d*. Such an arrangement of the first connecting pipe 4*a*, the second connecting pipe 4*b*, the check valve 13*a*, the check valve 13*b*, the check valve 13*c*, and the check valve 13*d* enables the refrigerant, to be allowed to flow into the heat medium relay unit 3, to flow in a constant direction irrespective of an operation requested by any indoor unit 2.

The compressor 10 is configured to suck the refrigerant and compress the refrigerant to a high-temperature high-pressure state, and may be a capacity-controllable inverter compressor, for example. The first refrigerant flow switching device 11 is configured to switch a direction of flow of the refrigerant during a heating operation (including a heating only operation mode and a heating main operation mode) to and from a direction of flow of the refrigerant during a cooling operation (including a cooling only operation mode and a cooling main operation mode). The heat source side heat exchanger 12 is configured to function as an evaporator during the heating operation and function as a condenser (or a radiator) during the cooling operation. In this case, the heat source side heat exchanger 12 exchanges heat between air supplied from an air-sending device (not illustrated) and the refrigerant, such that the refrigerant evaporates and gasifies or condenses and liquefies. The accumulator 19 is disposed on a suction side of the compressor 10 and is configured to store an excess amount of the refrigerant.

The check valve 13*a* is disposed in the refrigerant pipe 4 positioned between the heat source side heat exchanger 12 and the heat medium relay unit 3 and is configured to permit the refrigerant to flow only in a predetermined direction (the direction from the outdoor unit 1 to the heat medium relay unit 3). The check valve 13*b* is disposed in the first connecting pipe 4*a* and is configured to allow the refrigerant, discharged from the compressor 10 during the heating operation, to flow to the heat medium relay unit 3. The check valve 13*c* is disposed in the second connecting pipe 4*b* and is configured to allow the refrigerant, returned from the heat medium relay unit 3 during the heating operation, to flow to the suction side of the compressor 10. The check valve 13*d* is disposed in the refrigerant pipe 4 positioned between the heat medium relay unit 3 and the first refrigerant flow switching device 11 and is configured to permit the refrigerant to flow only in a predetermined direction (the direction from the heat medium relay unit 3 to the outdoor unit 1).

Figure 3:
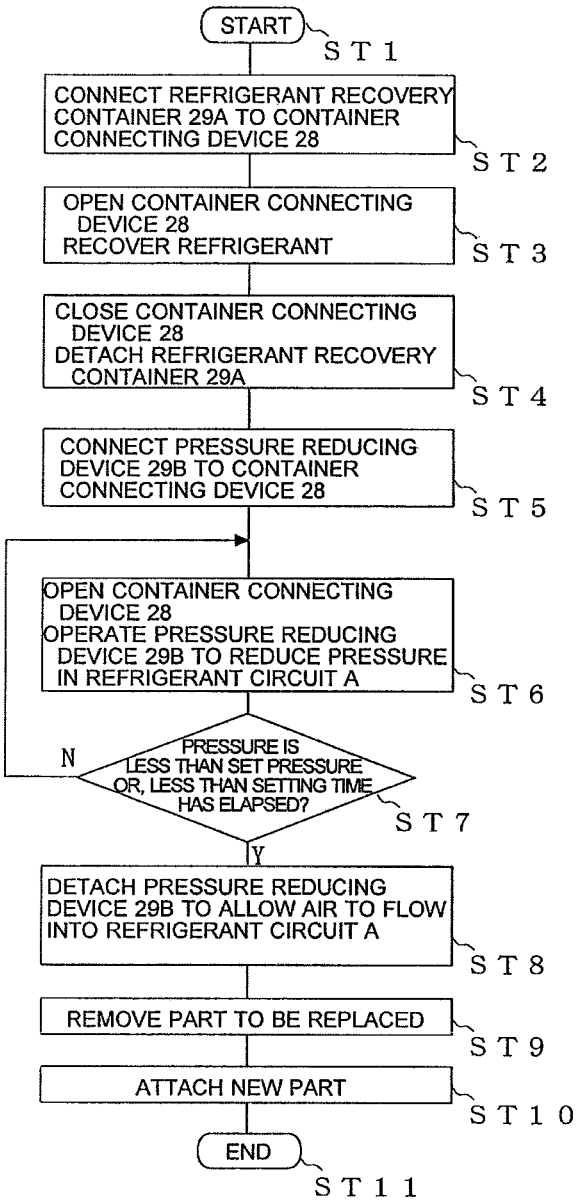
FIG. 3 is a diagram illustrating a flowchart of a part replacement procedure for the refrigeration cycle apparatus according to Embodiment of the invention.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat medium relay unit 3, in the outdoor unit 1. The second connecting pipe 4*b* is configured to connect the refrigerant pipe 4, positioned between the check valve 13*d* and the heat medium relay unit 3, to the refrigerant pipe 4, positioned between the heat source side heat exchanger 12 and the check valve 13*a*, in the outdoor unit 1. Furthermore, although FIG. 3 illustrates a case where the first connecting pipe 4*a*, the second connecting pipe 4*b*, the check valve 13*a*, the check valve 13*b*, the check valve 13*c*, and the check valve 13*d* are arranged, the arrangement is not limited to this case. These components do not necessarily have to be arranged.

Furthermore, an extraction pipe 27 to allow the refrigerant to flow out of the refrigerant circuit A is attached to the outdoor unit 1 in the refrigeration cycle apparatus 100 according to Embodiment. In addition, a container connecting device (connection valve) 28 is attached to the outdoor unit 1, the container connecting device 28 being configured to control the flow of the outgoing refrigerant through the extraction pipe 27 and enable, for example, a refrigerant recovery container (refrigerant recovery cylinder) 29A or a pressure reducing device (vacuum pump) 29B to be attached through, for example, a hose or a pipe. The container connecting device (connection valve) 28 may be directly connected to the pipe without the extraction pipe 27.

[Indoor Units 2]

The indoor units 2 each include a use side heat exchanger 26. This use side heat exchanger 26 is connected by the pipes 5 to a heat medium flow control device 25 and a second heat medium flow switching device 23 arranged in the heat medium relay unit 3. This use side heat exchanger 26 is configured to exchange heat between air supplied from an air-sending device, such as a fan (not illustrated), and the heat medium in order to produce heating air or cooling air to be supplied to the indoor space 7.

FIG. 2 illustrates a case where four indoor units 2 are connected to the heat medium relay unit 3. An indoor unit 2*a*, an indoor unit 2*b*, an indoor unit 2*c*, and an indoor unit 2*d* are illustrated in that order from the bottom of the drawing sheet. In addition, the use side heat exchangers 26 are illustrated as a use side heat exchanger 26*a*, a use side heat exchanger 26*b*, a use side heat exchanger 26*c*, and a use side heat exchanger 26*d* in that order from the bottom of the drawing sheet so as to correspond to the indoor units 2*a* to 2*d*, respectively. Note that the number of indoor units 2 connected is not limited to four as illustrated in FIG. 2 as in the case of FIG. 1.

[Heat Medium Relay Unit 3]

The heat medium relay unit 3 includes the two heat exchangers related to heat medium 15, two expansion devices 16, two opening and closing devices 17, two second refrigerant flow switching devices 18, two pumps 21, four first heat medium flow switching devices 22, the four second heat medium flow switching devices 23, and the four heat medium flow control devices 25.

Each of the two heat exchangers related to heat medium 15 (the heat exchanger related to heat medium 15*a* and the heat exchanger related to heat medium 15*b*) serves as a load side heat exchanger configured to function as a condenser (radiator) or an evaporator and exchange heat such that the refrigerant transfers cooling energy or heating energy, produced by the outdoor unit 1 and stored in the refrigerant, to the heat medium. The heat exchanger related to heat medium 15*a* is disposed between an expansion device 16*a* and a second refrigerant flow switching device 18*a* in the refrigerant circuit A and is used to cool the heat medium in a cooling and heating mixed operation mode. Furthermore, the heat exchanger related to heat medium 15*b* is disposed between an expansion device 16*b* and a second refrigerant flow switching device 18*b* in the refrigerant circuit A and is used to heat the heat medium in the cooling and heating mixed operation mode. Although the two heat exchangers related to heat medium 15 are arranged, one heat exchanger related to heat medium may be disposed. Alternatively, three or more heat exchangers related to heat medium may be arranged.

The two expansion devices 16 (the expansion device 16*a* and the expansion device 16*b*) each have functions of a reducing valve and an expansion valve and are configured to reduce the pressure of the refrigerant in order to expand it. The expansion device 16*a* is disposed in the upstream of the heat exchanger related to heat medium 15*a* in the flow direction of the refrigerant during the cooling operation. The expansion device 16*b* is disposed in the upstream of the heat exchanger related to heat medium 15*b* in the flow direction of the refrigerant during the cooling operation. Each of the two expansion devices 16 may be a component having a variably controllable opening degree, for example, an electronic expansion valve.

The two opening and closing devices 17 (an opening and closing device 17*a* and an opening and closing device 17*b*) each include a two-way valve and are configured to open or close the refrigerant pipe 4. The opening and closing device 17*a* is disposed in the refrigerant pipe 4 on an inlet side for the refrigerant. The opening and closing device 17*b* is disposed in a pipe connecting the refrigerant pipe 4 on the inlet side for the refrigerant and the refrigerant pipe 4 on an outlet side therefor. The two second refrigerant flow switching devices 18 (the second refrigerant flow switching device 18*a* and the second refrigerant flow switching device 18*b*) each include a four-way valve or the like and are configured to switch between flow directions of the refrigerant in accordance with an operation mode. The second refrigerant flow switching device 18*a* is disposed in the downstream of the heat exchanger related to heat medium 15*a* in the flow direction of the refrigerant during the cooling operation. The second refrigerant flow switching device 18*b* is disposed in the downstream of the heat exchanger related to heat medium 15*b* in the flow direction of the refrigerant in the cooling only operation.

The two pumps 21 (a pump 21*a* and a pump 21*b*) are arranged in one-to-one correspondence to the heat exchangers related to heat medium 15 and are configured to circulate the heat medium conveyed through the pipes 5. The pump 21*a* is disposed in the pipe 5 positioned between the heat exchanger related to heat medium 15*a* and the second heat medium flow switching devices 23. The pump 21*b* is disposed in the pipe 5 positioned between the heat exchanger related to heat medium 15*b* and the second heat medium flow switching devices 23. Each of the two pumps 21 may be, for example, a capacity-controllable pump.

The four first heat medium flow switching devices 22 (first heat medium flow switching devices 22*a* to 22*d*) each include a three-way valve and are configured to switch between passages for the heat medium. The first heat medium flow switching devices 22 whose number (four in this case) corresponds to the number of indoor units 2 installed are arranged. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the heat medium flow control device 25. Note that the first heat medium flow switching device 22*a*, the first heat medium flow switching device 22*b*, the first heat medium flow switching device 22*c*, and the first heat medium flow switching device 22*d* are illustrated in that order from the bottom of the drawing sheet so as to correspond to the indoor units 2.

The four second heat medium flow switching devices 23 (second heat medium flow switching devices 23*a* to 23*d*) each include a three-way valve and are configured to switch between passages for the heat medium. The second heat medium flow switching devices 23 whose number (four in this case) corresponds to the number of indoor units 2 installed are arranged. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the use side heat exchanger 26. Note that the second heat medium flow switching device 23*a*, the second heat medium flow switching device 23*b*, the second heat medium flow switching device 23*c*, and the second heat medium flow switching device 23*d* are illustrated in that order from the bottom of the drawing sheet so as to correspond to the indoor units 2.

The four heat medium flow control devices 25 (heat medium flow control devices 25*a* to 25*d*) each include a two-way valve capable of controlling the area of an opening and are configured to control the rate of flow through the pipe 5. The heat medium flow control devices 25 whose number (four in this case) corresponds to the number of indoor units 2 installed are arranged. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Note that the heat medium flow control device 25*a*, the heat medium flow control device 25*b*, the heat medium flow control device 25*c*, and the heat medium flow control device 25*d* are illustrated in that order from the bottom of the drawing sheet so as to correspond to the indoor units 2. Furthermore, each heat medium flow control device 25 may be disposed on the inlet side of the heat medium passage of the corresponding use side heat exchanger 26.

The heat medium relay unit 3 further includes various detecting devices (two outgoing heat medium temperature detecting devices 31, four heat medium outlet temperature detecting devices 34, four incoming/outgoing refrigerant temperature detecting devices 35, and a refrigerant pressure detecting device 36). Information items (temperature information items and pressure information) detected by these detecting devices are transmitted to a controller (not illustrated) that performs centralized control of an operation of the refrigeration cycle apparatus 100. The information items are used to control, for example, a driving frequency of the compressor 10, a rotation speed of each air-sending device (not illustrated), switching by the first refrigerant flow switching device 11, a driving frequency of the pumps 21, switching by the second refrigerant flow switching devices 18, and switching between passages for the heat medium.

Each of the two outgoing heat medium temperature detecting devices 31 (an outgoing heat medium temperature detecting device 31*a* and an outgoing heat medium temperature detecting device 31*b*) is a temperature sensor that detects a temperature of the heat medium flowing from the heat exchanger related to heat medium 15, namely, the heat medium on the outlet side of the heat exchanger related to heat medium 15 and may be a thermistor, for example. The outgoing heat medium temperature detecting device 31*a* is disposed in the pipe 5 on an inlet side of the pump 21*a*. The outgoing heat medium temperature detecting device 31*b* is disposed in the pipe 5 on an inlet side of the pump 21*b*.

Each of the four heat medium outlet temperature detecting devices 34 (heat medium outlet temperature detecting devices 34*a* to 34*d*) is disposed between the first heat medium flow switching device 22 and the heat medium flow control device 25 and is a temperature sensor that detects a temperature of the heat medium flowing from the use side heat exchanger 26 and may be a thermistor, for example. The heat medium outlet temperature detecting devices 34 whose number (four in this case) corresponds to the number of indoor units 2 installed are arranged. Note that the heat medium outlet temperature detecting device 34*a*, the heat medium outlet temperature detecting device 34*b*, the heat medium outlet temperature detecting device 34*c*, and the heat medium outlet temperature detecting device 34*d* are illustrated in that order from the bottom of the drawing sheet so as to correspond to the indoor units 2.

Each of the four incoming/outgoing refrigerant temperature detecting devices 35 (incoming/outgoing refrigerant temperature detecting devices 35*a* to 35*d*) is disposed on a refrigerant inlet or outlet side of the heat exchanger related to heat medium 15 and is a temperature sensor that detects a temperature of the refrigerant flowing into the heat exchanger related to heat medium 15, or a temperature of the refrigerant flowing out of the heat exchanger related to heat medium 15 and may be a thermistor, for example. The incoming/outgoing refrigerant temperature detecting device 35*a* is disposed between the heat exchanger related to heat medium 15*a* and the second refrigerant flow switching device 18*a*. The incoming/outgoing refrigerant temperature detecting device 35*b* is disposed between the heat exchanger related to heat medium 15*a* and the refrigerant expansion device 16*a*. The incoming/outgoing refrigerant temperature detecting device 35*c* is disposed between the heat exchanger related to heat medium 15*b* and the second refrigerant flow switching device 18*b*. The incoming/outgoing refrigerant temperature detecting device 35*d* is disposed between the heat exchanger related to heat medium 15*b* and the refrigerant expansion device 16*b*.

The refrigerant pressure detecting device (pressure sensor) 36 is disposed between the heat exchanger related to heat medium 15*b* and the refrigerant expansion device 16*b*, similar to the installation position of the incoming/outgoing refrigerant temperature detecting device 35*d*, and is configured to detect a pressure of the refrigerant flowing between the heat exchanger related to heat medium 15*b* and the expansion device 16*b*.

Furthermore, the controller (not illustrated) includes a microcomputer and controls, for example, the driving frequency of the compressor 10, switching by the first refrigerant flow switching device 11, driving of the pumps 21, the opening degree of each expansion device 16, opening and closing of each opening and closing device 17, switching by each second refrigerant flow switching device 18, switching by each first heat medium flow switching device 22, switching by each second heat medium flow switching device 23, and the opening degree of each heat medium flow control device 25 on the basis of signals related to detection by the various detecting devices and an instruction from a remote control, thus controlling an operation of the refrigeration cycle apparatus. Note that the controller may be provided for each unit or may be provided for the heat medium relay unit 3, for example.

The pipes 5 for conveying the heat medium include the pipes connected to the heat exchanger related to heat medium 15*a* and the pipes connected to the heat exchanger related to heat medium 15*b*. Each pipe 5 branches into pipes (four pipes 5*a* to 5*d* in this case) in accordance with the number of indoor units 2 connected to the heat medium relay unit 3. The pipes 5 are connected via the first heat medium flow switching devices 22 and the second heat medium flow switching devices 23. Controlling each first heat medium flow switching device 22 and each second heat medium flow switching device 23 determines whether the heat medium flowing from the heat exchanger related to heat medium 15*a* is allowed to flow into the corresponding use side heat exchanger 26 and whether the heat medium flowing from the heat exchanger related to heat medium 15*b* is allowed to flow into the corresponding use side heat exchanger 26.

In the refrigeration cycle apparatus 100, the compressor 10, the first refrigerant flow switching device 11, the heat source side heat exchanger 12, the opening and closing devices 17, the second refrigerant flow switching devices 18, a refrigerant passage of the heat exchanger related to heat medium 15*a*, the refrigerant expansion devices 16, and the accumulator 19 are connected by the refrigerant pipes 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected by the pipes 5, thus forming the heat medium circuits B. In other words, the plurality of use side heat exchangers 26 are connected in parallel with each of the heat exchangers related to heat medium 15, thus providing a plurality of heat medium circuits B.

Accordingly, in the refrigeration cycle apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are also connected through the heat exchanger related to heat medium 15*a* and the heat exchanger related to heat medium 15*b*. Consequently, in the refrigeration cycle apparatus 100, the heat exchanger related to heat medium 15*a* and the heat exchanger related to heat medium 15*b* exchange heat between the refrigerant circulating in the refrigerant circuit A and the heat medium circulating in the heat medium circuits B.

The operation modes performed by the air-conditioning apparatus 100 will now be described. The air-conditioning apparatus 100 enables each indoor unit 2, on the basis of an instruction from the indoor unit 2, to perform a cooling operation or heating operation. Specifically, the air-conditioning apparatus 100 enables all of the indoor units 2 to perform the same operation and also enables the indoor units 2 to perform different operations.

The operation modes performed by the air-conditioning apparatus 100 include the cooling only operation mode in which all of the operating indoor units 2 perform the cooling operation, the heating only operation mode in which all of the operating indoor units 2 perform the heating operation, the cooling main operation mode in which a cooling load is the larger, and the heating main operation mode in which a heating load is the larger.

[Pipes 5]

In the several operation modes performed by the refrigeration cycle apparatus 100 according to Embodiment, the heat medium, such as water or antifreeze, flows through the pipes 5 connecting the heat medium relay unit 3 and the indoor units 2.

[Method for Replacing Component of Refrigeration Cycle Apparatus 100]

The refrigeration cycle apparatus 100, such as an air-conditioning apparatus, performs the above-described operations under normal conditions. Here, it is assumed that the entrance of moisture, dust, or the like into the refrigerant circuit A caused by, for example, a mistake in on-site construction, age deterioration, or unintended operation causes a part (component), especially, a part constituting the refrigerant circuit A of the refrigeration cycle apparatus 100 to be broken and the broken part has to be replaced.

Parts include a part connected by means of brazing, for example, the compressor 10 fixed to the refrigerant pipes 4 by brazing using a brazing material heated with a burner or the like. The part may be fixed to the refrigerant pipes 4 with the brazing material heated and melted without a burner in such a manner that the surface temperature of each pipe is raised with electricity. The pipe may be heated to raise the surface temperature of the pipe and be fixed to the part by means other than brazing.

Conventionally, replacement of a broken part of the refrigeration cycle apparatus 100 is performed using the extraction pipe 27 for allowing the refrigerant to flow out of the refrigerant circuit A and the container connecting device (connection valve) 28, such as a check valve or a manual on-off valve, connected to the extraction pipe, the extraction pipe 27 and the container connecting device 28 being arranged in the refrigeration cycle apparatus 100.

According to a conventional procedure, for example, the refrigerant recovery container (refrigerant recovery cylinder) 29A is connected to the container connecting device (connection valve) 28 to provide a passage extending through the extraction pipe 27 and the container connecting device (connection valve) 28, such that the refrigerant flowing out of the refrigerant circuit A is recovered into the refrigerant recovery container (refrigerant recovery cylinder) 29A. When the recovery of the refrigerant from the refrigerant circuit A is substantially completed, the refrigerant recovery container (refrigerant recovery cylinder) 29A is detached and the container connecting device (connection valve) 28 is opened to the atmosphere. After that, the brazing material connecting the refrigerant pipes 4 and the part is heated and melted by means of, for example, exposure to the flame of a burner. The part is removed from the refrigerant pipes 4 and is then replaced with a new part.

In the refrigeration cycle apparatus 100 according to Embodiment, the refrigerant circuit A is filled with the refrigerant with flammability (or flammable refrigerant). The flammable refrigerant has a risk of ignition or the like. Whether the flammable refrigerant undergoes ignition or the like depends on the concentration of the refrigerant in the refrigerant circuit A. The lower the refrigerant concentration, the lower the probability of ignition or the like. If the concentration is below a limit, ignition or the like would not occur. The limit of concentration (kg/m$^3$) at which the flammable refrigerant does not undergo ignition or the like will be referred to as an LFL (Lower Flammability Limit). For example, the LFL of R32 is 0.306 (kg/m$^3$), the LFL of HFO1234yf (tetrafluoropropene) is 0.289 (kg/m$^3$), and the LFL of R290 (propane) is 0.038 (kg/m$^3$).

Furthermore, flammable refrigerants each have an auto ignition temperature (Auto Ignition Temperature) and have the property of undergoing ignition or the like when the concentration of the refrigerant exceeds its LFL and an object whose temperature exceeds the auto ignition temperature is present in a refrigerant atmosphere. For example, the auto ignition temperature of R32 is 648(° C.), that of HFO1234yf (tetrafluoropropene) is 405(° C.), and that of R290 (propane) is 470(° C.). The above-described conventional part replacement procedure alone cannot cause the concentration of the refrigerant in the refrigerant circuit A to be below the LFL. Accordingly, if the part is removed after heating with a burner or the like, the refrigerant in the pipes will mix with outside air such that the refrigerant at a concentration at or above the LFL is present in the air, thus establishing a state in which, for example, a pipe or flame at a temperature at or above the auto ignition temperature is present. The refrigerant may undergo ignition or the like.

The refrigeration cycle apparatus 100, which uses the flammable refrigerant, requires a new method of part replacement, the method including reducing the concentration of the refrigerant in the refrigerant circuit A to a value below the LFL, heating the refrigerant pipes 4 with a burner or the like, and replacing a part. The method will be described below.

Let V (m$^3$) denote the total internal volume of a portion in which the refrigerant flows in the refrigerant circuit A of the refrigeration cycle apparatus 100 and let ρ (kg/m$^3$) denote the mean density of the refrigerant in the refrigerant circuit A. The weight, m1, (kg) of the refrigerant in the refrigerant circuit A is given by Equation (1).

$$m1 = V \times \rho \tag{1}$$

The refrigerant density ρ (kg/m$^3$) expresses the weight of refrigerant per unit volume. Furthermore, the LFL (kg/m$^3$) is the refrigerant concentration expressed by the weight of refrigerant per unit volume. These parameters are expressed in the same unit. In other words, the weight, m, (kg) of refrigerant having a volume V (m$^3$) measured when the refrigerant concentration in the refrigerant circuit A is at the LFL (kg/m$^3$) is given by Equation (2).

$$m = V \times \mathrm{LFL} \tag{2}$$

Additionally, when M (g/mol) denotes the molecular weight of refrigerant and n (mol) denotes the number of moles of refrigerant measured when the refrigerant concentration in the refrigerant circuit A is at the LFL (kg/m$^3$), Equation (3) holds.

$$n = (m \times 1000)/M \tag{3}$$

As regards the refrigerant in a gas state, when P (Pa) denotes the pressure of the gas, V (m$^3$) denotes the volume of the gas, n (mol) denotes the number of moles of the gas, R (Pa×L/(K×mol)) denotes the gas constant, and T (K) denotes the temperature, the equation of gas state holds as expressed by Equation (4). Here, the gas constant R is $8.31447 \times 10^3$ (Pa×L/(K×mol)).

$$P \times V = n \times R \times T \tag{4}$$

Substituting Equations (2) and (3) into Equation (4) yields Equation (5). Rearranging Equation (5) yields Equation (6).

$$P \times V = [\{V \times \mathrm{LFL}) \times 1000\}/M] \times R \times T \tag{5}$$

$$P = (\mathrm{LFL} \times R \times 1000/M) \times \mathrm{T} \tag{6}$$

As described above, when the pressure in the refrigerant circuit A (e.g., the refrigerant pipes 4) of the refrigeration cycle apparatus 100 is lower than the pressure P expressed by Equation (6), the refrigerant concentration in the refrigerant circuit A (e.g., the refrigerant pipes 4) is below the LFL. Accordingly, the refrigerant will not undergo ignition or the like. Pressures of several refrigerants will be calculated using Equation (6).

In the case where the refrigerant is R32, the chemical formula is $CH_2F_2$, the LFL is 0.306 (kg/m$^3$), and the molecular weight M is 52 (g/mol). Substituting these parameters into Equation (6) yields Equation (7).

$$P=48.93\times T \tag{7}$$

In the case where R32 is used as the refrigerant, therefore, as long as the pressure in the refrigerant circuit A (e.g., the refrigerant pipes 4) is reduced to a value less than the pressure P expressed by Equation (7) for part replacement involving brazing or the like, the concentration of the refrigerant will not exceed the LFL even when the outside air mixes with the refrigerant remaining in the pipes. Accordingly, the refrigerant will not undergo ignition or the like. Thus, a part can be replaced safely.

It is assumed that the refrigerant reaches the same temperature (room temperature) as that of ambient air after stop of the operation of the refrigeration cycle apparatus 100 and the temperature is 25° C. (298.15 (K)). Substituting this temperature as a typical temperature T of refrigerant in the refrigeration cycle apparatus 100 into Equation (7) yields a pressure P of 14587.8 (Pa). In the use of R32 as a refrigerant, therefore, as long as the pressure in the refrigerant circuit A (e.g., the refrigerant pipes 4) is reduced to a more specific value, for example, a pressure less than 14587.8 (Pa) for part replacement involving brazing or the like, the refrigerant will not undergo ignition or the like. A part can be replaced safely. In many cases, a multi-air-conditioning apparatus for a building is operated such that the temperature of a refrigerant in a condenser, serving as a high-pressure side of the compressor 10, is approximately 50° C. and that in an evaporator, serving as a low-pressure side of the compressor 10, is approximately 0° C. during operation. For example, assuming that the part is to be replaced just after stop of the operation of the refrigeration cycle apparatus 100, as long as the pressure in the refrigerant circuit A (e.g., the refrigerant pipes 4) is reduced to be less than 13364.6 (Pa), as a pressure obtained by substituting 0° C. as the typical refrigerant temperature T in the refrigeration cycle apparatus 100 into Equation (7), the part can be replaced more safely.

As regards a refrigerant mixture of R32 and a refrigerant having lower flammability than R32, a set pressure may be determined on the basis of the LFLs of the refrigerant components as described later. If the pressure is reduced to the above-described value, the safety can be further increased.

It is assumed that HFO1234yf (tetrafluoropropene) is used as a refrigerant. The chemical formula of HFO1234yf (tetrafluoropropene) is $CF_3CF{=}CH_2$, the LFL thereof is 0.289 (kg/m$^3$), and the molecular weight M thereof is 114 (g/mol). Substituting these parameters into Equation (6) yields Equation (8).

$$P=21.08\times T \tag{8}$$

In the case where HFO1234yf is used as a refrigerant, therefore, as long as the pressure in the refrigerant circuit A (e.g., the refrigerant pipes 4) is reduced to be less than the pressure expressed by Equation (7) for part replacement involving brazing or the like, the refrigerant will not undergo ignition or the like. Thus, a part can be replaced safely.

Substituting T=298.15 (K) (25(° C.)) into Equation (8) yields a pressure P of 6284.4 (Pa). As long as the pressure in the refrigerant circuit A (e.g., the refrigerant pipes 4) is reduced to a more specific value, for example, a pressure less than 6284.4 (Pa) for part replacement involving brazing or the like, brazing or the like can be performed safely for the same reason as described above. A part can be replaced safely. Furthermore, assuming that the part is to be replaced just after stop of the operation of the refrigeration cycle apparatus 100, as long as the pressure in the refrigerant circuit A (e.g., the refrigerant pipes 4) is reduced to be less than 5757.5 (Pa), as a pressure obtained by substituting T=273.15 (K) (0(° C.)) into Equation (8), the part can be replaced more safely.

As regards a refrigerant mixture of HFO1234yf (tetrafluoropropene) and a refrigerant having lower flammability than HFO1234yf (tetrafluoropropene), a set pressure may be determined on the basis of the LFLs of the refrigerant components as described later. If the pressure is reduced to the above-described value, the safety can be further increased.

It is assumed that R290 (propane) is used as a refrigerant. The chemical formula of R290 (propane) is $C_3H_8$, the LFL thereof is 0.038 (kg/m$^3$), and the molecular weight M thereof is 44.1 (g/mol). Substituting these parameters into Equation (6) yields Equation (9).

$$P=7.17\times T \tag{9}$$

In the case where R290 is used as a refrigerant, therefore, as long as the pressure in the refrigerant circuit A (e.g., the refrigerant pipes 4) is reduced to be less than the pressure expressed by Equation (9) for part replacement involving brazing or the like, the refrigerant will not undergo ignition or the like. Thus, a part can be replaced safely.

Substituting T=298.15 (K) (25(° C.)) into Equation (9) yields a pressure P of 2136.1 (Pa). As long as the pressure in the refrigerant circuit A (e.g., the refrigerant pipes 4) is reduced to a more specific value, for example, a pressure less than 2136.1 (Pa) for part replacement involving brazing or the like, brazing or the like can be performed safely for the same reason as described above. Thus, the part can be replaced safely. Furthermore, assuming that the part is to be replaced just after stop of the operation of the refrigeration cycle apparatus 100, as long as the pressure in the refrigerant circuit A (e.g., the refrigerant pipes 4) is reduced to be less than 1957.0 (Pa), as a pressure obtained by substituting T=273.15 (K) (0(° C.)) into Equation (9), the part can be replaced more safely.

The use of R290 (propane) as a refrigerant has been described. As regards a refrigerant mixture of R290 (propane) and a refrigerant having lower flammability than R290 (propane), a set pressure may be determined on the basis of the LFLs of the refrigerant components as described later. If the pressure is reduced to the above-described value, the safety can be further increased.

In a case where a composition of a plurality of flammable refrigerants is used as a refrigerant, a set pressure is more accurately determined in accordance with the ratio (proportion) based on the LFLs of the refrigerant components. For example, assuming that the composition is composed of two refrigerants, let M1 (g/mol) and M2 (g/mol) denote the molecular weight of a first refrigerant component and that of a second refrigerant component, respectively. In addition, R (Pa×L/K×mol) denotes the gas constant and T (K) denotes the refrigerant typical temperature in the refrigerant circuit A (e.g., the refrigerant pipes 4). Furthermore, let LFL1 (kg/m$^3$) and LFL2 (kg/m$^3$) denote the lower flammability limit of the first refrigerant component and that of the second refrigerant component, respectively. The pressure P (Pa) can be given by Equation (10). Although not particularly limited, for example, the whole refrigerant is defined as 100 and the percentage of each component to the whole refrigerant is determined (the same shall apply hereinafter). If the pressure in the refrigeration cycle apparatus 100 can be lower than the pressure P given by Equation (10), the refrigerant in the pipes will not undergo ignition or the like.

$$P = \{(LFL1 \times \text{the percentage of the first refrigerant component} + LFL2 \times \text{the percentage of the second refrigerant component}) \times R \times 1000/(M1 \times \text{the percentage of the first refrigerant component} + M2 \times \text{the percentage of the second refrigerant component})\} \times T \quad (10)$$

For example, in the use of a refrigerant mixture containing HFO1234yf and R32, the pressure in the refrigeration cycle apparatus 100 may be set to a value less than the pressure P given by Equation (11).

$$P = (48.93 \times \text{the percentage of } R32 + 21.08 \times \text{the percentage of } HFO1234yf) \times T \quad (11)$$

Substituting T=298.15 (K) (25(° C.)) into Equation (11) yields Equation (12). The pressure in the refrigeration cycle apparatus 100 may be set to a value less than the pressure P given by Equation (12).

$$P = 14587.8 \times \text{the percentage of } R32 + 6284.4 \times \text{the percentage of } HFO1234yf \quad (12)$$

For example, when R32 is 20% (=0.2) and HFO1234yf is 80% (=0.8), a set pressure less than 7945.08 (Pa) may be used.

Substituting T=273.15 (K) (0(° C.)) into Equation (11) yields Equation (13). As long as the pressure in the refrigeration cycle apparatus 100 is set to a value less than the pressure P given by Equation (13), a part can be replaced more safely.

$$P = 13364.6 \times \text{the percentage of } R32 + 5757.5 \times \text{the percentage of } HFO1234yf \quad (13)$$

Furthermore, a setting time to reduce the pressure in the refrigeration cycle apparatus 100 (the refrigerant circuit A) to be less than a predetermined pressure will be described below. For example, V ($m^3$) denotes the internal volume of the refrigerant circuit A (e.g., the refrigerant pipes 4). For example, assuming that the pressure in the refrigeration cycle apparatus 100 is reduced through a vacuum pump, let S ($m^3$/min) denote the rate of exhaust by the vacuum pump. The volume of a gas exhausted during a minimal time Δt (min) is given by S×Δt ($m^3$). Let P (Pa) denote the pressure of the gas. The amount (pressure×volume) of the gas is expressed by S×P×Δt. Furthermore, let −ΔP (Pa) denote the pressure reduced during Δt. The amount of the gas exhausted from a container is obtained by −V×ΔP. Since these amounts are equal to each other, Equation (14) is obtained.

$$V \times \Delta P = -S \times P \times \Delta t \quad (14)$$

Let P1 (Pa) denote the pressure of the gas at time 0 (s). Solving the differential equation of Equation (14) yields Equation (15).

$$P = P1 \times \exp(-S \times t/V) \quad (15)$$

Equation (15) is expanded. Let P2 (Pa) denote the final pressure (predetermined pressure) in the refrigerant circuit A (e.g., the refrigerant pipes 4) of the refrigeration cycle apparatus 100. The time t (min) required for pressure reduction can be obtained by Equation (16).

$$t = (V/S) \times \log_e(P1/P2) = (V/S) \times 2.303 \times \log_{10}(P1/P2) \quad (16)$$

The internal volume V of the refrigerant circuit A (e.g., the refrigerant pipes 4) in the refrigeration cycle apparatus 100 can be obtained by dividing the weight (kg) of the refrigerant in the refrigeration cycle by the mean density ρ (kg/$m^3$) of the refrigerant. For example, for the sake of simplicity, when the refrigerant mean density is defined as the mean of liquid and gas densities, 500 (kg/$m^3$), and the refrigerant weight in the refrigeration cycle is 30 (kg), the internal volume V of the refrigerant circuit A (e.g., the refrigerant pipes 4) in the refrigeration cycle apparatus 100 is obtained as 0.06 ($m^3$). Furthermore, it is assumed that the pump exhaust rate S is 0.02 ($m^3$/min) and the initial pressure P1 in the refrigerant circuit A (e.g., the refrigerant pipes 4) is 101325 (Pa) (atmospheric pressure).

As regards the final pressure P2 of the refrigerant, the final pressure P2 of R32 is 13364.6 (Pa), that of HFO1234yf is 5757.5 (Pa), and that of propane is 1957.0 (Pa) as obtained above. Substituting each of the values into Equation (16) gives the following result: 6 minutes 5 seconds in the use of R32 as a refrigerant, 8 minutes 36 seconds in the use of HFO1234yf, and 11 minutes 51 seconds in the use of propane. If the refrigeration cycle apparatus 100 is subjected to a pressure reducing operation for the above-described time or more, the refrigerant density in the refrigerant circuit A can be reduced to be less than the LFL. Thus, a part can be replaced safely. Furthermore, if the pressure is reduced to a value corresponding to a refrigerant temperature of 0° C., the replacement can be performed more safely.

If the refrigerant weight (kg) in the refrigeration cycle apparatus 100 and the exhaust rate ($m^3$/min) of the pressure reducing device 29B are known, the pressure reduction time required to reduce the pressure to a predetermined value can be estimated. Accordingly, the pressure in the refrigeration cycle apparatus 100 (the refrigerant circuit A) can be reduced to a safe value using the estimated pressure reduction time as a setting time without measuring the pressure using, for example, a pressure gauge.

As described above, if the kind of refrigerant or the target reduced pressure P2 based on the kind of refrigerant, the total internal volume V of the refrigerant circuit A (e.g., the refrigerant pipes 4) in the refrigeration cycle apparatus 100, and the exhaust rate S of the pressure reducing device (vacuum pump) are set, the setting time can be calculated. The pressure reducing device (vacuum pump) 29B is operated for the setting time to reduce the pressure in the refrigeration cycle apparatus 100, so that the pressure in the refrigeration cycle apparatus 100 can be reduced to be less than the target reduced pressure. Accordingly, if the refrigeration cycle apparatus 100 is not provided with a pressure detecting device, a part can be replaced safely. The total internal volume V of the refrigerant circuit A (e.g., the refrigerant pipes 4) in the refrigeration cycle apparatus 100 may be determined by, for example, actual measurement. Alternatively, the total internal volume V may be calculated and estimated on the basis of the name or capacity of a model as the refrigeration cycle apparatus 100 and values, such as an extension pipe length, from which the internal volume can be estimated.

If the pressure reducing device (vacuum pump) 29B to be used is determined, the exhaust rate of the pressure reducing device (vacuum pump) 29B is a default value. With such configuration, inputting of the value can be omitted in calculation. Furthermore, if a plurality of pressure reducing devices (vacuum pumps) 29B can be used, the exhaust rate of the pressure reducing device (vacuum pump) 29B having the lowest exhaust rate among the pressure reducing devices (vacuum pumps) 29B may be used as a default value. With this configuration, inputting the value can be omitted in calculation. Alternatively, the relation between these parameters and the setting time may be calculated to illustrate (form), for example, a diagram (e.g., a graph) or a table in advance. The setting time for the air-conditioning apparatus may be determined on the basis of, for example, the diagram on site.

FIG. 3 is a diagram illustrating a flowchart describing a part replacement procedure in accordance with Embodiment of the present invention. The process of part replacement will be described with reference to FIGS. 2 and 3.

As illustrated in FIG. 3, the replacement process starts (ST1). The refrigerant recovery container (refrigerant recovery cylinder) 29A is connected to the container connecting device (connection valve) 28 (ST2) and the container connecting device (connection valve) 28 is opened to provide a refrigerant passage between the refrigerant circuit A and the refrigerant recovery container (refrigerant recovery cylinder) 29A. The refrigerant in the refrigeration cycle apparatus 100 is recovered into the refrigerant recovery container (refrigerant recovery cylinder) 29A (ST3). At the completion of the recovery, the container connecting device (connection valve) 28 is closed and the refrigerant recovery container (refrigerant recovery cylinder) 29A is detached from the container connecting device (connection valve) 28 (ST4).

The pressure reducing device (vacuum pump) 29B is then connected to the container connecting device (connection valve) 28 (ST5). The container connecting device (connection valve) 28 is opened to provide a refrigerant passage between the refrigerant circuit A and the pressure reducing device (vacuum pump) 29B. The pressure reducing device (vacuum pump) 29B is operated to reduce the pressure in the refrigeration cycle apparatus 100 (the refrigerant circuit A) (ST6). If the pressure in the refrigerant cycle apparatus 100 is less than a set pressure, or if a setting time has elapsed (ST7), the pressure reducing device (vacuum pump) 29B is detached from the container connecting device (connection valve) 28 while the container connecting device (connection valve) 28 is being opened, thus allowing the ambient air to flow into the refrigeration cycle apparatus 100 (ST8). At this time, the refrigerant density in the refrigerant circuit A (e.g., the refrigerant pipes 4) is less than the LFL.

Brazing joints in a part of the refrigeration cycle apparatus 100 (the refrigerant circuit A) are exposed to, for example, the flame of a burner and the part is removed from pipes (ST9). A new replacement part is attached to the pipes by brazing (ST10). The process is completed (ST11).

In this case, the container connecting device (connection valve) 28 may be a valve that can be manually opened and closed or may be a check valve in which, for example, a passage can be provided when a protrusion is pressed. The container connecting device (connection valve) 28 may be any other component capable of opening and closing a passage between the refrigeration cycle apparatus 100 and an external device.

The case where the refrigerant in the refrigeration cycle apparatus 100 is recovered into the refrigerant recovery container (refrigerant recovery cylinder) 29A has been described above as an example. For example, in the use of a refrigerant having a low global warming potential, if the outside of the refrigeration cycle apparatus 100 is adequately ventilated, the refrigerant can be discharged (purged) little by little in the vicinity of the refrigeration cycle apparatus 100 such that the concentration of the refrigerant in the vicinity of the refrigeration cycle apparatus 100 is not increased. No problems will occur because, for example, the refrigerant concentration in the vicinity of the refrigeration cycle apparatus 100 is not increased and an impact on the global environment is accordingly small.

As for the pressure reducing device (vacuum pump) 29B, an electric motor-driven vacuum pump is typically used. If the refrigeration cycle apparatus 100 has a small internal volume, a container filled with an adsorbent is attached to the container connecting device 28 to adsorb the refrigerant onto the adsorbent in the container. Thus, the pressure in the pressure refrigerant circuit A (e.g., the refrigerant pipes 4) in the refrigeration cycle apparatus 100 can be reduced. The pressure reducing device 29B may be any other component capable of reducing the pressure in the refrigerant circuit A (e.g., the refrigerant pipes 4) in the refrigeration cycle apparatus 100.

Although the ambient air is allowed to flow into the refrigeration cycle apparatus 100 in ST8 in FIG. 3, the valve of the container connecting device 28 may be closed such that the ambient air does not flow into the refrigeration cycle apparatus 100 and the process may then proceed to the next step ST9.

In the refrigeration cycle apparatus 100, in the case where the heating load and the cooling load are simultaneously generated in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 may include a component which can switch between passages, for example, a three-way valve capable of switching between flow directions in a three-way passage or two two-way valves, such as on-off valves, opening or closing a two-way passage used in combination. Alternatively, as each of the first heat medium flow switching devices 22 and the second heat medium flow switching devices 23, a component, such as a stepping-motor-driven mixing valve, capable of changing a flow rate in a three-way passage may be used, or, two components, such as electronic expansion valves, capable of changing a flow rate in a two-way passage may be used in combination. In this case, water hammer caused when a passage is suddenly opened or closed can be prevented. Furthermore, although Embodiment has been described with respect to the case where the heat medium flow control devices 25 each include a two-way valve, each of the heat medium flow control devices 25 may include a control valve having a three-way passage and the valve may be disposed with a bypass pipe that bypasses the corresponding use side heat exchanger 26.

Furthermore, as regards each of the heat medium flow control devices 25, a component capable of controlling a flow rate in a passage in a stepping-motor-driven manner may be used. Alternatively, a two-way valve or a three-way valve whose one end is closed may be used. Alternatively, as regards each of the heat medium flow control devices 25, a component, such as an on-off valve, opening or closing a two-way passage may be used such that an average flow rate is controlled while ON and OFF operations are repeated.

Furthermore, although each second refrigerant flow switching device 18 is illustrated as a four-way valve, the device is not limited to this valve. A plurality of two-way or three-way flow switching valves may be used such that the refrigerant flows in the same way.

Although the refrigeration cycle apparatus 100 has been described with respect to the case where the apparatus can perform the cooling and heating mixed operation, the apparatus is not limited to this case. For example, if the apparatus is configured such that one heat exchanger related to heat medium 15 and one expansion device 16 are arranged, a plurality of use side heat exchangers 26 and a plurality of heat medium flow control devices 25 are arranged in parallel with these components, and either the cooling operation or the heating operation can be performed, the same advantages can be achieved.

In addition, it is needless to say that the same holds true for the case where one use side heat exchanger 26 and one heat medium flow control valve 25 are connected. Moreover, if a plurality of components acting in the same way are arranged as each of the heat exchanger related to heat medium 15 and the expansion device 16, obviously, no problems will occur. Furthermore, although the case where the heat medium flow control valves 25 are arranged in the heat medium relay unit 3 has been described, the arrangement is not limited to this case. Each heat medium flow control device 25 may be disposed in the indoor unit 2. The heat medium relay unit 3 may be separated from the indoor unit 2.

As regards the heat medium, for example, brine (antifreeze), water, a mixed solution of brine and water, or a mixed solution of water and an additive with a high corrosion protection effect can be used. In the refrigeration cycle apparatus 100, therefore, if the heat medium leaks through the indoor unit 2 into the indoor space 7, the safety of the heat medium used is high. Accordingly, it contributes to safety improvement.

Typically, each of the heat source side heat exchanger 12 and the use side heat exchangers 26*a* to 26*d* is provided with the air-sending device and a current of air often facilitates condensation or evaporation. The structure is not limited to this case. For example, a heat exchanger, such as a panel heater, using radiation can be used as each of the use side heat exchangers 26*a* to 26*d* and a water-cooled heat exchanger which transfers heat using water or antifreeze can be used as the heat source side heat exchanger 12. Any type heat exchanger configured to be capable of transferring heat or removing heat can be used as each of the heat source side heat exchanger 12 and the use side heat exchangers 26*a* to 26*d*.

Although Embodiment has been described with respect to the case where the four use side heat exchangers 26*a* to 26*d* are arranged, any number of use side heat exchangers may be connected.

In addition, although Embodiment has been described with respect to the case where the two heat exchangers related to heat medium 15*a* and 15*b* are arranged, obviously, the arrangement is not limited to this case. As long as each heat exchanger related to heat medium 15 is configured to be capable of cooling or/and heating the heat medium, the number of the heat exchangers related to heat medium 15 arranged is not limited.

Furthermore, as regards each of the pumps 21*a* and 21*b*, the number of pumps is not limited to one. A plurality of pumps having a small capacity may be arranged in parallel.

Furthermore, the refrigeration cycle apparatus 100 is not limited to the type described above. The same holds true for a direct expansion refrigeration cycle apparatus in which the refrigerant is circulated to each indoor unit. The same advantages can be achieved. In addition, the refrigeration cycle apparatus 100 may be of any type in which a refrigerant is circulated, for example, a multi-air-conditioning apparatus for a building, a packaged air-conditioning apparatus, a room air-conditioning apparatus, a refrigeration apparatus, or a refrigerating apparatus.

As described above, according to the method of part replacement for the refrigeration cycle apparatus 100 in accordance with Embodiment, for replacement of a part in the refrigerant circuit A, for example, exhaust through the pressure reducing device (vacuum pump) 29B is performed while being controlled on the basis of, for example, the pressure in the refrigerant circuit A and operating time of the pressure reducing device (vacuum pump) 29B so that the concentration of a flammable refrigerant remaining in the refrigeration cycle is reduced to be less than the lower flammability limit and the part is then removed using, for example, a burner. Advantageously, the part can be safely removed from the refrigeration cycle apparatus and be replaced without causing, for example, ignition.

The invention claimed is:

1. A method for replacement of a part of a refrigeration cycle apparatus including a compressor that compresses a flammable refrigerant, a condenser that condenses the refrigerant by heat exchange, an expansion device that controls a pressure of the condensed refrigerant, and an evaporator that exchanges heat between the pressure-reduced refrigerant and air to evaporate the refrigerant, the compressor, the condenser, the expansion device, and the evaporator being connected by pipes to form a refrigerant circuit, the method comprising:

a refrigerant recovery step of allowing the refrigerant to flow out of the refrigerant circuit through a container connecting device;

a pressure reduction step of connecting a pressure reducing device to the container connecting device to reduce a pressure in the refrigerant circuit through the container connecting device such that the pressure in the refrigerant circuit becomes equal to or less than a set pressure or until a time equal to or greater than a setting time elapses; and a part replacement step of removing the part from the refrigerant circuit by heating to replace the part, wherein the set pressure is a pressure less than a value expressed by LFL×1000×R×T/M (Pa) where M (g/mol) denotes a molecular weight of the refrigerant, R (Pa×L/K×mol) denotes a gas constant, T (K) denotes a typical temperature of the refrigerant in the refrigerant circuit, and LFL (kg/m3) denotes a lower flammability limit of the refrigerant.

2. The method of claim 1, wherein the setting time is determined on the basis of a kind of the refrigerant or a pressure based on the kind of the refrigerant, a total internal volume of a portion in which the refrigerant flows in the refrigerant circuit, the total internal volume being obtained by measurement or estimation, and an exhaust rate of the pressure reducing device.

3. The method of claim 1, wherein the relation between the setting time, a kind of the refrigerant or a pressure based on the kind of the refrigerant, a total internal volume of a portion in which the refrigerant flows in the refrigerant circuit, the total internal volume being obtained by measurement or estimation, and an exhaust rate of the pressure reducing device is illustrated as a diagram in advance and the setting time is determined on the basis of the diagram.

4. The method of claim 1, wherein the refrigerant is R32 or a refrigerant mixture of R32 and a refrigerant having lower flammability than R32 and the set pressure is a pressure less than a value expressed by 48.93×T (Pa) where T (K) denotes a typical temperature of the refrigerant in the refrigerant circuit.

5. The method of claim 1, wherein the set pressure is less than 13364.6 (Pa).

6. The method of claim 1, wherein the refrigerant is HFO1234yf or a refrigerant mixture of HFO1234yf and a refrigerant having lower flammability than HFO1234yf and the set pressure is a pressure less than a value expressed by 21.08×T (Pa) where T (K) denotes a typical temperature of the refrigerant in the refrigerant circuit.

7. The method of claim 1, wherein the set pressure is less than 5757.5 (Pa).

8. The method of claim 1, wherein the refrigerant is R290 or a refrigerant mixture of R290 and a refrigerant having lower flammability than R290 and the set pressure is a pressure less than a value expressed by 7.17×T (Pa) where T (K) denotes a typical temperature of the refrigerant in the refrigerant circuit.

9. The method of claim 1, wherein the set pressure is less than 1957.0 (Pa).

10. The method of claim 1, wherein the refrigerant is a refrigerant mixture containing at least two flammable refrigerants which serve as a first refrigerant component and a second refrigerant component and the set pressure is a pressure less than a value expressed by (LFL1×a percentage of the first refrigerant component+LFL2×a percentage of the second refrigerant component)×1000×R×T/(M1×the percentage of the first refrigerant component+M2×the percentage of the second refrigerant component) (Pa) where M1 (g/mol) and M2 (g/mol) denote molecular weights of the first and second refrigerant components, respectively, R (Pa×L/K×mol) denotes a gas constant, T (K) denotes a typical temperature of the refrigerant in the refrigerant circuit, and LFL1 ($kg/m^3$) and LFL2 ($kg/m^3$) denote lower flammability limits of the first and second refrigerant components, respectively.

11. The method of claim 1, wherein the refrigerant is a refrigerant mixture containing HFO1234yf and R32 and the set pressure is a pressure less than a value expressed by (48.93×a percentage of R32+21.08×a percentage of HFO1234yf)×T (Pa) where T (K) denotes a typical temperature of the refrigerant in the refrigerant circuit.

12. The method of claim 1, wherein the set pressure is less than a value expressed by 13364.6×a percentage of R32+5757.5×a percentage of HFO1234yf (Pa).

* * * * *